US006863187B1

(12) United States Patent
Robertson

(10) Patent No.: US 6,863,187 B1
(45) Date of Patent: Mar. 8, 2005

(54) GUN SUPPORT APPARATUS

(76) Inventor: Phil A. Robertson, 538 Mouth of Cypress Rd., West Monroe, LA (US) 71292

( * ) Notice: Subject to any disclaimer, the term of this patent is extended or adjusted under 35 U.S.C. 154(b) by 0 days.

(21) Appl. No.: 10/638,669

(22) Filed: Aug. 11, 2003

(51) Int. Cl.[7] ..... A47F 7/00
(52) U.S. Cl. ..... 211/64
(58) Field of Search ..... 211/64, 60.1

(56) References Cited

U.S. PATENT DOCUMENTS

| | | | | | |
|---|---|---|---|---|---|
| 493,645 | A | * | 3/1893 | Pague | 211/64 |
| 1,914,259 | A | * | 6/1933 | Irwin | 224/311 |
| 2,070,904 | A | * | 2/1937 | Jennings | 211/64 |
| 2,287,805 | A | * | 6/1942 | Johnson | 211/64 |
| 2,919,058 | A | * | 12/1959 | Thompson | 224/546 |
| 3,022,898 | A | | 2/1962 | Loeb | |
| 4,696,461 | A | | 9/1987 | Zelinski | |
| 5,044,590 | A | | 9/1991 | Carafice | |
| 5,476,188 | A | | 12/1995 | Hassenpflug | |
| D375,644 | S | | 11/1996 | Foster et al. | |
| 5,626,379 | A | | 5/1997 | Scott | |
| D398,949 | S | | 9/1998 | Franks | |
| 5,819,462 | A | | 10/1998 | Dockery | |
| 5,833,102 | A | * | 11/1998 | Jacobson | 224/275 |
| 5,937,559 | A | * | 8/1999 | Jennen | 42/94 |
| 6,382,484 | B1 | | 5/2002 | Savant | |
| 6,457,685 | B1 | | 10/2002 | Taylor | |

* cited by examiner

*Primary Examiner*—Hugh B. Thompson, II
*Assistant Examiner*—Sarah Purol
(74) *Attorney, Agent, or Firm*—Locke Liddell & Sapp; Monty L. Ross

(57) ABSTRACT

A gun support apparatus having two cooperatively engageable, elongate body sections adapted to receive and support a rifle or shotgun with the barrel in an upright position, in combination with at least one mounting bracket that releasably engages at least one of the body sections and is also attachable to an underlying support surface such as the floor or bottom of a hunting blind, tree stand or other such structure. The body sections are of sufficient height to shield and protect the trigger of the gun when the gun is supported in the apparatus. The mounting bracket can include, as either an additional or alternative feature, a stake member that is insertable downwardly into the ground so that the subject gun support apparatus can be used in locations where there is no hard underlying surface to which the mounting bracket can be attached.

24 Claims, 2 Drawing Sheets

GUN SUPPORT APPARATUS

BACKGROUND OF THE INVENTION

1. Field of the Invention

This invention relates to apparatus useful for supporting a shotgun or rifle in an upright, barrel-up position relative to an underlying support surface while simultaneously protecting the firearm against accidental discharge.

2. Description of Related Art

Hunters accustomed to hunting for prolonged periods from blinds and stands are well aware of the need for a safe place to rest a rifle or shotgun when not in use. There are many times when a hunter cannot or may not want to hold the firearm continuously in his or her hands. For example, a hunter may need to put a firearm down to use a game call or binoculars, or to eat or drink, or simply to rest during a hunt. In such instances, it is important for safety considerations to place the firearm in a position where it is safe from accidental discharge and yet readily accessible to the hunter if a need arises. Many hunting accidents have occurred in blinds and stands when rifles or shotguns propped up or leaning against an object have fallen over and discharged. This is particularly likely to occur when several hunters or hunting dogs are present in a blind, and can even occur when the safety has been engaged if the safety is released due to movements of people or animals in proximity to a falling gun. A gun support apparatus is therefore needed that can safely and conveniently support a rifle or shotgun in an upright position where it is available for use and yet well protected from accidental discharge.

Prior art gun support devices are disclosed, for example, in U.S. Pat. Nos. 3,022,898; 4,696,461; 5,044,590; 5,476,188; 5,626,379; 5,819,462; 6,382,484; 6,457,685; Des. 375,644 and Des. 398,949.

SUMMARY OF THE INVENTION

As used herein, "gun" generally refers to non-military shoulder arms such as rifles and shotguns used for hunting wildlife. Such guns typically have an elongated barrel extending forwardly from a receiver and trigger assembly, and an elongated stock with a butt portion extending rearwardly from the receiver and trigger assembly. For purposes of this invention, such guns are distinguished from pistols or other side arms.

A gun support apparatus is disclosed that preferably comprises at least two cooperatively engageable, elongate body sections adapted to receive and support a rifle or shotgun with the barrel in an upright position, in combination with at least one mounting bracket that releasably engages at least one of the body sections and is also attachable to an underlying support surface such as the floor or bottom of a hunting blind, tree stand or other such structure. The body sections are desirably of sufficient height to support the gun and shield and protect the trigger from accidental discharge when the gun is placed in the apparatus while not in use. The mounting brackets of the subject apparatus can include, as either an additional or alternative feature, a stake member that is insertable downwardly into the ground so that the subject gun support apparatus can be used in locations where there is no hard underlying surface to which the mounting bracket can be attached.

The gun support apparatus disclosed herein preferably comprises two cooperatively engageable, elongate body sections and two mounting brackets, each mounting bracket being releasably engageable with one of the body sections and also attachable to an underlying support surface such as the floor or bottom of a hunting blind, tree stand or other such structure. If desired, each mounting bracket can comprise as either an additional feature or as an alternative feature, a stake member that is insertable downwardly into the ground so that the subject gun support apparatus can be used in locations where there is no hard underlying surface to which the bracket members can be attached.

According to a preferred embodiment of the invention, each body section of the gun support apparatus further comprises at least one receiver structure into or through which an upwardly projecting portion of the mounting bracket can be inserted to provide releasable engagement between the mounting bracket and the body section. According to a particularly preferred embodiment of the invention, each upwardly projecting portion of the mounting bracket further comprises a latch member that is releasably engageable with a cooperating retention member on the respective body section that prevents each body section and its respective mounting bracket from accidentally disengaging, especially when the gun is rapidly withdrawn from the apparatus while hunting.

According to another preferred embodiment of the invention, alternate mounting brackets are provided that comprise a downwardly projecting stake, which stake is insertable into the ground to anchor the apparatus where there is no underlying structure to which the mounting brackets can be attached.

BRIEF DESCRIPTION OF THE DRAWINGS

Preferred embodiments of the apparatus of the invention are further described and explained in relation to the following figures of the drawings wherein.

Like reference numerals are used to indicate like parts in all figures of the drawings.

DESCRIPTION OF THE PREFERRED EMBODIMENTS

Figure 1:
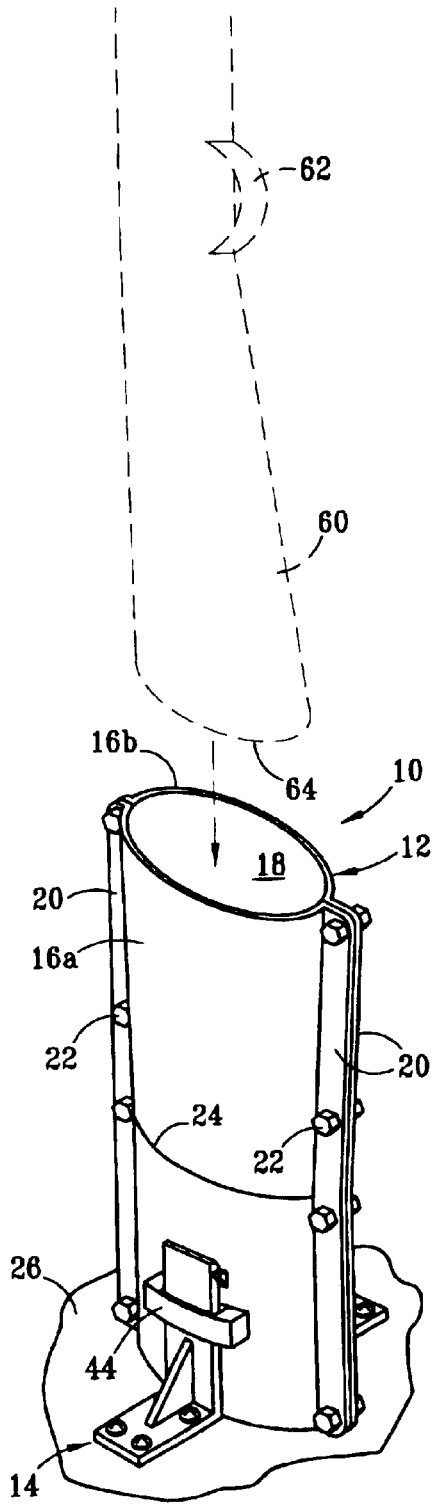
FIG. 1 is a perspective view of the gun support apparatus of the invention installed on an underlying support surface, with a shotgun shown in dashed outline prior to insertion into the apparatus.
Figure 3:
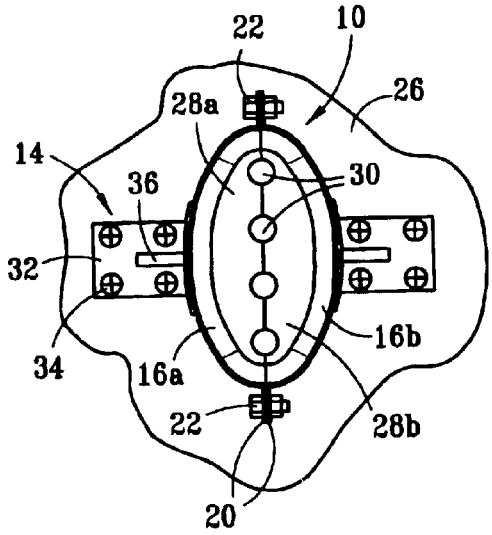
FIG. 3 is a top plan view of the gun support apparatus of FIG. 1

FIG. 1 depicts in dashed outline the general configuration of a gun having a stock 60 with butt 64 and a trigger guard 62. Referring to FIGS. 1 and 3, butt 64 of stock 60 is desirably inserted through the open top of gun support apparatus 10 and downwardly into interior space 18 until butt 64 contacts and rests on bottom sections 28*a*, 28*b*, at which time trigger guard 62 and the associated trigger (not shown) are preferably disposed within interior space 18. Body 12 desirably has top edges 52*a*, 52*b* (FIG. 4) of sufficient height to support the gun in a substantially upright position and also shield and protect the trigger from accidental discharge when the gun is placed in apparatus 10 while not in use. The cross-sectional area of interior space 18 is preferably sufficiently large to permit the gun to be inserted and withdrawn without difficulty.

Figure 2:
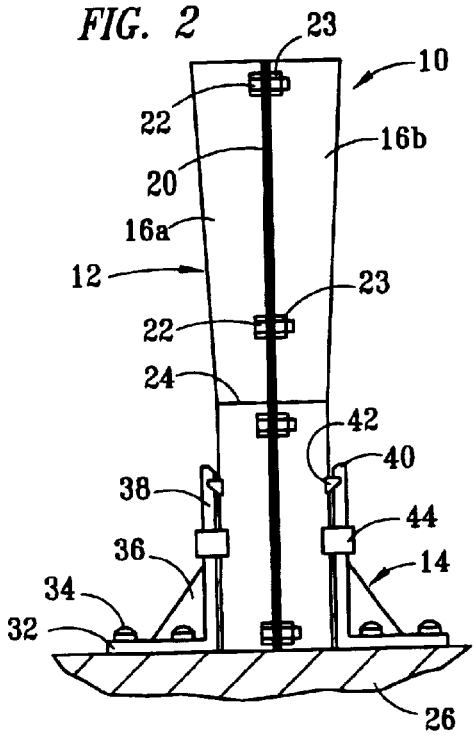
FIG. 2 is a front elevation view of gun support apparatus of FIG. 1.

Referring to FIGS. 1 and 2, gun support apparatus 10 of the invention comprises a body 12 adapted to receive and support a rifle or shotgun with the barrel in an upright position and at least one mounting bracket 14 that releasably engages body 12 and is attachable to an underlying support surface 26 such as the floor or bottom of a hunting blind, tree stand or other such structure. Body 12 preferably comprises at least two cooperatively engageable, curved, elongate body sections 16*a*, 16*b*, that taper outwardly between line 24 and the top to facilitate quick insertion and removal of a gun from interior space 18. Interior space 18 most preferably has a cross-section with an oval or elliptical configuration. Although body sections can be made with side walls that are not curved, such body sections are presently thought to be less convenient to manufacture and use. Body sections 16*a*, 16*b* further comprise and are desirably joined along longitudinally extending flange members 20 that are disposed in facing and contacting engagement, and held together by fasteners such as screws 22 and nuts 23, or other similarly effective means well known to those of skill in the art. Similarly, body sections 16*a*, 16*b* can be made so as to snap together without the use of external fastening devices.

Figure 4:
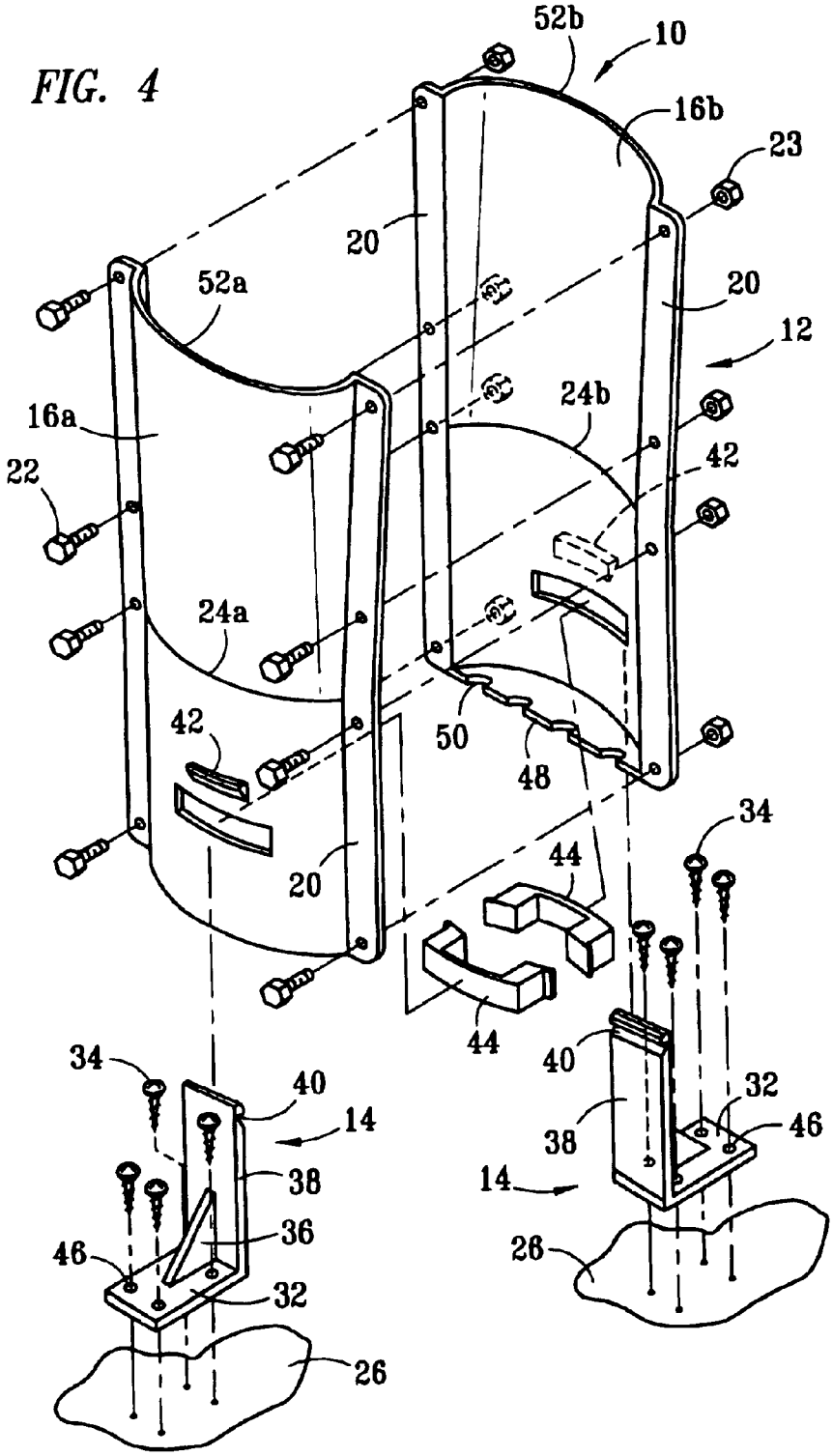
FIG. 4 is an exploded perspective view of the gun support apparatus of FIG. 1.

Referring to FIG. 3, elongate body sections 16*a*, 16*b* preferably further comprise transverse bottom sections 28*a*, 28*b*, respectively. Bottom sections 28*a*, 28*b* desirably cooperate to form a bottom to interior space 18 (FIG. 1) and preferably comprise a plurality of apertures 30 that are provided to facilitate drainage and prevent water from accumulating inside body 12 if gun support apparatus 10 is exposed to falling precipitation during use. Referring to FIG. 4, apertures 30 are actually formed in this preferred embodiment of the invention by providing alternating linear and recessed curvilinear edge sections 48, 50, respectively, along the facing portions of bottom sections 28*a*, 28*b*. As will be apparent to those of skill in the art upon reading this disclosure, gun support apparatus 10 can be similarly provided with a unitary bottom section that can be joined to body sections 16*a*, 16*b* during assembly and prior to use.

Each elongate body section 16*a*, 16*b* desirably further comprises a receiving member 44 for use in releasably joining body 12 and mounting brackets 14. Receiving member 44 can comprise an insert that cooperates with the respective body section to define an opening through which a portion of mounting bracket 14 is inserted, or a pocket (not shown) disposed in the sidewall of the body section, or another structure that is similarly effective for use in joining mounting bracket 14 to body 12. Referring to FIGS. 1–3, two mounting brackets 14 are preferably provided so that one mounting bracket 14 can releasably engage each body section 16*a*, 16*b*. Each mounting bracket 14 preferably comprises a base 32, brace member 36 and upwardly projecting portion 38. Base 32 preferably comprises holes 46 (FIG. 4) through which screws 34 can be inserted to releasably secure mounting bracket 14 to an underlying support surface 26 such as the floor of a blind or hunting stand. Brace 36 provides rigidity and structural reinforcement to upwardly projecting portion 38 and to body 12. Upwardly projecting portion 38 is preferably made with a hook 40 near its top end, hook 40 being configured to be insertable into and pass through receiving member 44 of one of body sections 16*a*, 16*b*, and then releasably engage a detent member 42, which is best seen in FIGS. 2 and 4.

Figure 5:
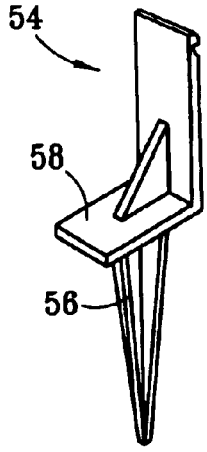
FIG. 5 is a perspective view of an alternate mounting bracket comprising a downwardly directed stake that can be inserted into the ground.

Although the use of two mounting brackets (one for each body section 16*a*, 16*b*) is preferred, it will be appreciated that sufficient support for body 12 can also be provided in some instances using a single mounting bracket 14 that is attachable to only one of body sections 16*a*, 16*b*, or that is made with a web or strap member passing beneath bottom sections 28*a*, 28*b* so that mounting bracket 14 can be attached to both body sections and also to an underlying support surface. Also, if desired, body 12 can also be provided with at least one loop or other attachment member through which a strap or the like can be inserted to bind body 12 of gun support apparatus 10 to a tree or post. Referring to FIG. 5, one or more alternate mounting brackets 54 can be provided for use with the gun support apparatus of the invention. Mounting bracket 54 differs from mounting bracket 14 as previously described in that downwardly projecting stake member 56 is provided beneath base 58 for use in securing mounting bracket 54 to a ground surface where there is no underlying structural member beneath body 12 (FIG. 2) to which screws or other similar fastening devices can be attached. With this alternate mounting bracket 54, the user need only position stake 56 in a desired location and then step on base 58 to force stake 56 into the ground. Depending upon factors such as ground hardness, etc. mounting bracket 54 can be installed into the ground either prior or subsequent to attachment to body 12.

The assembly of a preferred gun support apparatus 10 of the invention is further described and explained in relation to FIG. 4. Receiving members 44 can be separately molded and inserted through slots shown in body sections 16*a*, 16*b*. Flanges formed around the inwardly facing bases of receiving members 44 prevent them from being pulled through the slots when engaged by upwardly projecting portions 38 of mounting brackets 14. Receiving members 44 can be assembled to body sections 16*a*, 16*b* either before or after body sections 16*a*, 16*b* are joined to each other using screws 22 and nuts 23. Mounting brackets 14 are attached to body 12 by inserting upwardly projecting portions 38 through receiving members until hook 40 engages detent member 42, which can be integrally formed as part of the respective body sections 16*a*, 16*b* or can be inserted through a slot at for receiving members 44, or attached using any other similarly effective device or method. Hooks 40 are desirably made so that they are biased into releasable engagement with detent members 42. Braces 36 reinforce upwardly projecting portions 38 and can facilitate the biasing of hooks 40. Mounting brackets 14 are desirably secured to an underlying support surface made of wood by the use of screws 34 inserted through holes 46 in base 32.

Those of skill in the art will realize upon reading this disclosure that body 12 can be made of various materials such as metal, thermoformable or moldable plastics, fiberglass, or other similarly effective materials, and can be made with an interior space having different cross-sectional shapes. According to a preferred embodiment, elongate body sections 16*a*, 16*b* are made of a moldable polymeric resin and each has a configuration identical to that of the other to reduce tooling and manufacturing costs. Although body 12 can be made of unitary construction or with hinged or interlocking sections, the use of flanges and fasteners as disclosed herein is particularly preferred.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

What is claimed is:

1. A gun support apparatus comprising at least two upright, cooperatively engageable, elongate body sections and at least one mounting bracket releasably attachable to at least one of the elongate body sections, each body section comprising a curved wall, two opposed flange members, and an outwardly facing receiving member;

each mounting bracket comprising a base, an upwardly projecting portion insertable into the receiving member of a body section, the projecting portion further comprising a latching member that is releasably engageable with the body section.

2. The gun support apparatus of claim 1 wherein the curved wall of at least one elongate body section has a top portion that is outwardly tapered.

3. The gun support apparatus of claim 2 wherein the curved wall of each elongate body section has a top portion that is outwardly tapered.

4. The gun support apparatus of claim 1 wherein each elongate body section further comprises at least one longitudinally extending flange member connected to the curved wall.

5. The gun support apparatus of claim 4 wherein each elongate body section further comprises longitudinally extending flange members with the curved wall disposed therebetween.

6. The gun support apparatus of claim 5 wherein each longitudinally extending flange member of one elongate body section is disposed in facing and contacting engagement with a longitudinally extending flange member of the other elongate body section.

7. The gun support apparatus of claim 1 wherein the at least two elongate body sections are interconnected by a plurality of fasteners.

8. The gun support apparatus of claim 7 wherein the at least two elongate body sections are releasably interconnected.

9. The gun support apparatus of claim 8 wherein the at least two elongate body sections are interconnected with a plurality of threaded fasteners.

10. The gun support apparatus of claim 1 comprising exactly two elongate body sections.

11. The gun support apparatus of claim 10 wherein each elongate body section further comprises a bottom section.

12. The gun support apparatus of claim 1 comprising two mounting brackets.

13. The gun support apparatus of claim 1 wherein the base of a mounting bracket is attachable to an underlying support surface.

14. The gun support apparatus of claim 11 wherein the bottom sections of the elongate body sections cooperate to form a bottom having drain apertures.

15. The gun support apparatus of claim 1 wherein the elongate body sections are made of a moldable polymeric material.

16. The gun support apparatus of claim 1 wherein each receiving member is unitarily molded together with the curved wall of an elongate body section.

17. The gun support apparatus of claim 1 wherein each elongate body section further comprises at least one structure that is releasably engageable with the latching member of the projecting portion of a mounting bracket.

18. The gun support apparatus of claim 17 wherein the structure comprises a detent.

19. The gun support apparatus of claim 7 wherein the interconnected elongate body sections define an interior cavity having a cross-sectional area and height sufficient to receive and support a gun in an upright position.

20. The gun support apparatus of claim 19 wherein the interconnected elongate body sections are sufficiently tall to shield a trigger guard of a gun supported in the apparatus.

21. The gun support apparatus of claim 13 wherein each mounting bracket base comprises at least one aperture through which a fastener is insertable.

22. The gun support apparatus of claim 1 wherein each mounting bracket base comprises a downwardly projecting stake.

23. The gun support apparatus of claim 1 wherein the latching member comprises a hook.

24. The gun support apparatus of claim 19 wherein the at least one mounting bracket will stabilize and support the apparatus in an upright position when a gun stock is received into the cavity.

* * * * *